US005213457A

United States Patent [19]

Maas et al.

[11] Patent Number: 5,213,457

[45] Date of Patent: May 25, 1993

[54] PLANER WITH IMPROVED BEARING MOUNTING

[75] Inventors: Johannes M. Maas, Teteringen; Antonie J. Moolenaar, Dorst, both of Netherlands

[73] Assignee: Emerson Electric Co., Netherlands

[21] Appl. No.: 806,597

[22] Filed: Dec. 12, 1991

[30] Foreign Application Priority Data

Dec. 21, 1990 [NL] Netherlands ..... 90 02865

[51] Int. Cl.[5] ..... B27C 1/00

[52] U.S. Cl. ..... 409/175; 144/134 D; 409/181

[58] Field of Search ..... 409/175, 180, 228, 229, 409/204, 218, 234; 144/117 C, 117 R, 131, 134 D; 407/40, 47, 53, 56

[56] References Cited

U.S. PATENT DOCUMENTS

| | | | |
|---|---|---|---|
| 2,540,258 | 2/1951 | Harris . | |
| 3,171,454 | 3/1965 | Boice . | |
| 3,207,195 | 9/1965 | Anton . | |
| 3,253,624 | 5/1966 | Legan et al. | 144/117 C |
| 4,347,882 | 9/1982 | Bachmann | 144/225 |
| 4,382,729 | 5/1983 | Bachmann . | |
| 4,506,711 | 3/1985 | Armbruster et al. | 144/117 R |
| 4,557,305 | 12/1985 | Berger et al. | 144/117 R |
| 4,749,014 | 6/1988 | Schlund | 144/117 C |

FOREIGN PATENT DOCUMENTS

| | | |
|---|---|---|
| 45730 | 2/1982 | European Pat. Off. . |
| 1520140 | 2/1968 | France . |
| 295348 | 8/1928 | United Kingdom . |

*Primary Examiner*—Daniel W. Howell

*Attorney, Agent, or Firm*—Jones, Day, Reavis & Pogue

[57] ABSTRACT

The invention relates to a device for performing a machining movement with at least one rotatable planing knife, comprising: a planing knife holder fixed rotatably in a carrier with a first and a second shaft and a first and a second bearing, wherein at least the first shaft is connected fixedly to the planing knife holder and at least the first shaft is bearing mounted in the carrier; a motor fixed in the carrier; and a drive wheel which is fixed on the first shaft and coupled to the electric motor for driving the planing knife holder, wherein the second shaft is connected fixedly to the carrier and that the second bearing is arranged on the shaft inside the body of the planing knife holder.

Because only the second shaft has to be fixed directly onto the carrier, without interposing of a bearing, on the side of the second shaft the distance between the underside of the carrier and the underside of the planing knife holder is enlarged; and this by the difference between the internal and the external diameter of the bearing.

11 Claims, 3 Drawing Sheets

PLANER WITH IMPROVED BEARING MOUNTING

The invention relates to a device for performing a machining movement with at least one rotatable planing knife, comprising:

a planing knife holder fixed rotatably in a carrier with a first and a second shaft and a first and a second bearing, wherein at least the first shaft is connected fixedly to the planing knife holder and at least the first shaft is bearing mounted in the carrier;

a motor fixed in the carrier; and a drive wheel which is fixed on the first shaft and coupled to the electric motor for driving the planing knife holder.

Such devices are generally known. In most of these known devices the second shaft is fixedly attached to the planing knife holder, and the second shaft is mounted in the second bearing that is fixedly attached in the carrier. It is also possible for both shafts to be formed into one entity. When a groove has to be machined, for example planed, with such a machine forming part of the prior art, the problem arises that the maximum depth of such a groove for machining is limited. This limitation is formed by the distance between the bottom edge of the planing knife holder and the bottom edge of the carrier in which the bearings are fixed.

The object of the invention is to provide such a device with which grooves of a greater depth can be machined.

Efforts have of course long been made to increase the distance between the underside of the planing knife holder and the bottom edges of the carrier which is typically formed by the housing. This dimension is however limited by constructional requirements. It is for instance not attractive to allow the diameter of the planing knife holder to exceed a certain maximum value.

The object of the invention is to provide such a known device wherein, while preserving an acceptably dimensioned construction, the depth of a groove for machining can be enlarged.

This object is achieved in that the second shaft is connected fixedly to the carrier, and the second bearing is arranged on the shaft inside the body of the planing knife holder.

Because only the second shaft has to be fixed directly onto the carrier, without interposing of a bearing, on the side of the second shaft the distance between the underside of the carrier and the underside of the planing knife holder is enlarged; and this by the difference between the internal and the external diameter of the bearing.

It is of course also the endeavor to apply a similar construction on the other side. With a classic drive this is not possible, however, since the first shaft has to be rigidly connected to the planing knife holder in order to enable placing of a drive wheel on the shaft to enable driving of the planing knife holder. The presence of a bearing in the carrier cannot therefore be dispensed with on one side.

Such a drive wheel can take the form of a gear wheel, that is driven by a pinion fixed on the shaft of an electric motor, or by a pulley or a chain wheel for driving by a belt or chain.

It would of course be possible to employ such a construction on both sides when a classic drive is not used. Such a situation would be possible for instance when employing a motor integrated in the planing knife holder. This has not been found possible up to the present.

According to a preferred embodiment the second bearing is formed by a needle bearing. This has the advantage that the diameter of the planing knife holder can be reduced.

According to a second embodiment the first bearing is also formed by a needle bearing. This enlarges the maximum groove depth on the side of the first bearing.

The invention will subsequently be further elucidated with reference to the annexed drawings, in which.

Figure 1:
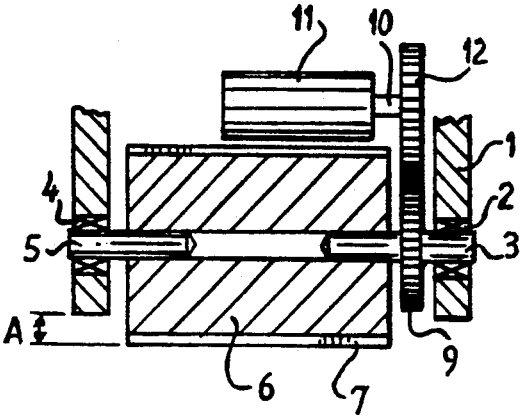
FIG. 1 shows a schematic sectional view of a planing machine forming part of the prior art.

Arranged in the schematically depicted housing 1 in the planing machine of the prior art shown in FIG. 1 is a first bearing 2 that is preferably formed by a needle bearing and in which a first shaft 3 is bearing mounted. Arranged in the housing 1 on the other side is a second bearing 4 that is preferably formed by a needle bearing and in which a second shaft 5 is bearing mounted. Both shafts 3, 5 lie mutually in line. Arranged around the shafts and concentrically therewith is the planing knife holder 6 in which two planing knives 7, 8 are placed in positions diametrically opposite one another. Arranged on the first shaft 3 is a gear wheel 9 that is in engagement with a pinion 12 fixed on the shaft 10 of an electric motor 11. The electric motor 11, which is otherwise fixedly attached in the carrier in a manner not shown, drives the shaft 3, and therewith the planing knife holder 6, via the shaft 10, the pinion 12 and the gear wheel 9.

As will be apparent from FIG. 1 the maximum groove depth for machining is limited by the dimension A. The dimension A can be influenced by reducing the thickness of the portion of the carrier 1 under the bearing 4, which is not desirable for reasons of strength, or by increasing the diameter of the planing knife holder 6, which likewise meets with dimensional drawbacks.

Figure 2:
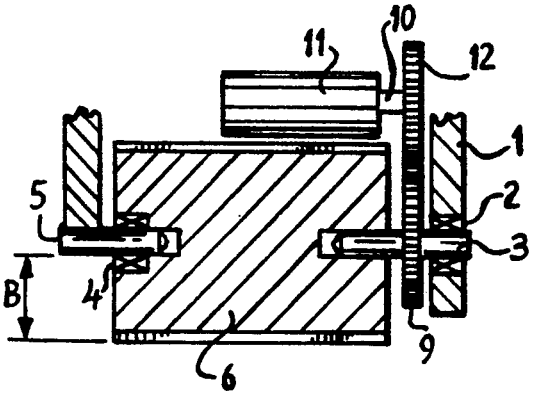
FIG. 2 shows a schematic sectional view of a planing machine according to the invention.

In the planing machine shown in FIG. 2 the second bearing is arranged inside the body of the planing knife holder 6. The shaft 5 extends inside this bearing. The shaft 5 is directly connected to the carrier 1 for example by welding or other means. Due to the absence of the second bearing 4 in the wall of the carrier 1 and the fixing of the shaft 5 directly to the carrier, the maximum groove depth for machining on the left-hand side of the drawing is increased to the dimension B.

Figure 3:
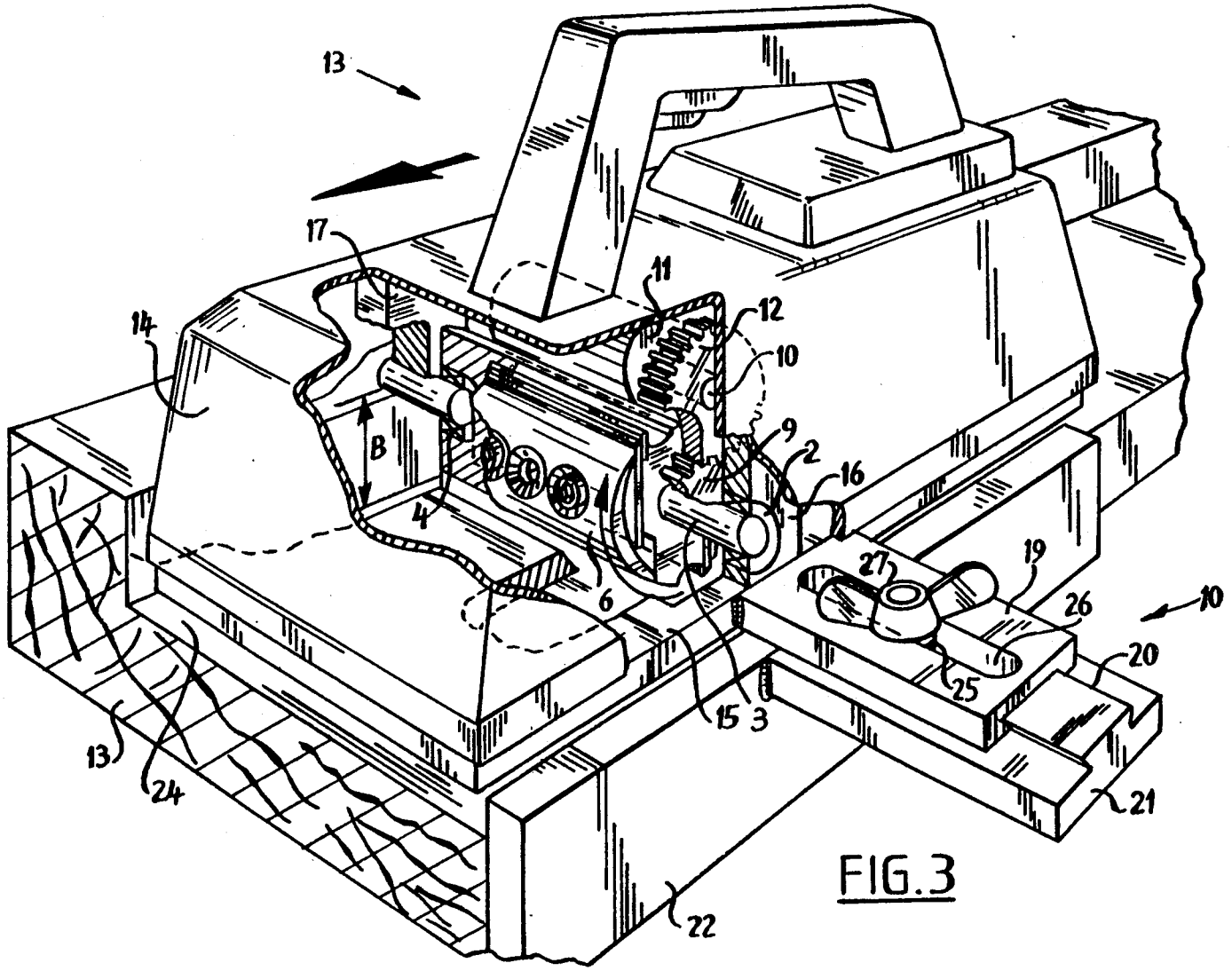
FIG. 3 is a partially broken away perspective view of a stationary planing machine according to the invention.

Shown in FIG. 3 is a planing machine 13 which is formed by a housing 14, under which a foot plate 15 is fixed. Arranged on the foot plate 15 is an upward extending side wall 16 in which a first bearing 2 is arranged. A second side wall 17 is arranged on the other side of the machine. Both side walls 16, 17 form a carrier in which the electric motor Il is also fixed. The first shaft 3 is bearing mounted in the first bearing 2, while the second shaft 5 is fixedly attached to the second side wall 17, for example by welding. Inside the body of the planing knife holder 6 the second bearing 4 is arranged on the free end of the second shaft. Further arranged on the first shaft 3 is the gear wheel 9 which is in engagement with the pinion 12 that is fixed onto the shaft 10 of the electric motor 11.

Further fixed to the foot plate 15 is an adjusting device 18, which is formed by plate 19 which is slidably connected by means of a dovetail joint 20 to a bottom plate 21 which is fixedly connected to a frame plate 22. The dovetail joint allows sideways movement of the planing machine relative to the frame plate 22, so that the width of a groove 24 to be arranged in a workpiece 23 for machining can be adjusted herewith.

A tap end 25 which extends through a slot 26 arranged in the top plate 19 is arranged for fixing the setting. A wing nut 27 is turned on the tap end 25.

The workpiece 23 is guided here by guide means not shown in the drawing, wherein it is moved through beneath the planing machine, and wherein the planing knives fixed in the rotating planing knife holder 6 plane off material from the workpiece. It will be apparent herein that due to the steps according to the invention the maximum allowable depth of the groove for planing out is increased considerably.

Figure 4:
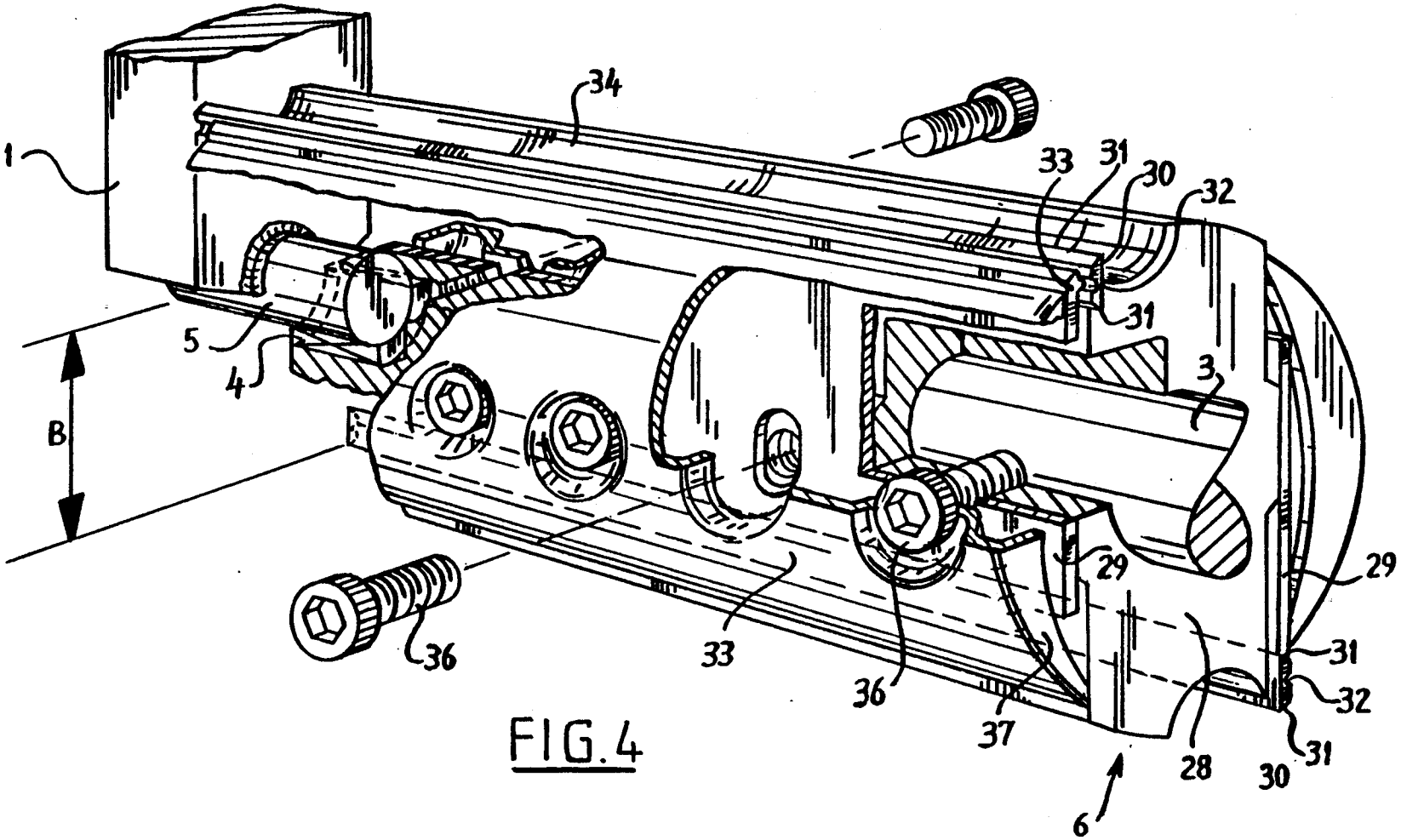
FIG. 4 shows a partially broken away detail view of a planing knife holder forming part of a planing machine according to the invention.

FIG. 4 gives a detail view of the planing knife holder 6 according to the invention. The planing knife holder 6 is formed by a basic body 28. The first shaft 3 is fixedly attached in and the second bearing 4 is received into the basic body 28.

A planing knife setting plate 29 is arranged on both flat sides of the basic body 28. A planing knife 30 is arranged in the vicinity of one of the edges of the flat side of the basic body 28. The planing knife 30 is provided with a cutting surface 31 on both long edges, while a groove 32 is arranged in the middle of one of the sides of the planing knife 30. The planing knife setting plate 29 is provided with an edge 33 which engages into the groove arranged in the planing knife 30. The planing knife setting plate 29 is connected to the basic body 28 by means of bolt 38.

Arranged in the basic body 28 at the rear of the planing knife 30 is a recess 34 is for carrying away chips. Further arranged on the free side of the planing knife setting plate 29 is a planing knife clamp plate 35 which is fixed in the basic body 28 by means of bolts 36. The planing knife clamp plate 35 is provided with bent edges 37 which, when the bolts 36 are tightened, exerts a force on the planing knife setting plate 29 whereby the planing knife 30 is fixed.

The above construction allows of rapid exchange or turning over of the planing knife 30 in order to use both cutting surfaces 31 of the planing knives 30. For this purpose only the bolts 36 have to be released, whereafter the planing knife can be pushed out sideways and pushed in again after being turned over, wherein the position of the planing knife is maintained by the planing knife setting plate. The planing knife clamp plate 35 also prevents excessive noise generation.

Although the above invention is elucidated with reference to a planing machine, the invention is likewise applicable with other machining devices, such as a milling machine.

We claim:

1. Device for performing a machining movement with at least one rotatable planing knife, comprising:
   - a planing knife holder fixed rotatably in a carrier with a first and a second shaft and a first and a second bearing, wherein at least the first shaft is connected fixedly to the planing knife holder and at least the first shaft is bearing mounted in the carrier;
   - a motor fixed in the carrier; and
   - a drive wheel which is fixed on the first shaft and coupled to the motor for driving the planing knife holder, the second shaft being connected fixedly to the carrier and the second bearing being arranged on the shaft inside the body of the planing knife holder.

2. Device as claimed in claim 1, wherein the second bearing is a needle bearing.

3. Device as claimed in claim 1, wherein the first bearing is a needle bearing.

4. Device as claimed in claim 1, 2 or 3, wherein the device is a planing machine.

5. Device as claimed in claim 4, wherein the device is a manually movable planing machine.

6. Device as claimed in claim 4 wherein the planing knife holder is formed by a cylindrical body provided with two flat sides, and that a planing knife setting plate provided with a ridge is fixable against both flat sides, wherein the ridge engages onto a groove arranged in the planing knife and determines thereby the position of the planing knife.

7. Device as claimed in claim 6, wherein the planing knife is provided on both edges with a cutting surface and is provided on both sides with a groove.

8. Device as claimed in claim 6 wherein the planing knife setting plate lies flat against a flat side of the cylindrical body and is fixable by means of a bolt.

9. Device as claimed in claim 8, wherein a planing knife clamp is fixable against each planing knife setting plate.

10. Device as claimed in claim 1 further comprising a gear wheel arranged on the first shaft, the gear wheel being engaged with a pinion which is fixed on the shaft of a motor.

11. Device as claimed in claim 10, wherein the motor is an electric motor.

* * * * *